US005839490A

United States Patent [19]

Kiedaisch et al.

[11] Patent Number: 5,839,490

[45] Date of Patent: Nov. 24, 1998

[54] RUBBER LINING FOR CORRUGATED DEBARKING DRUM

[75] Inventors: Edward Kiedaisch, Keokuk, Iowa; Thomas E. McGrew, Riverton, Utah

[73] Assignee: Svedala Industries, Inc., Waukesha, Wis.

[21] Appl. No.: 42,816

[22] Filed: Mar. 17, 1998

[51] Int. Cl.[6] ..... B02C 17/22

[52] U.S. Cl. ..... 144/208.9; 144/208.1; 144/341; 241/183; 241/DIG. 30

[58] Field of Search ..... 241/102, 182, 241/183, DIG. 30; 144/208.1, 208.9, 340, 341

[56] References Cited

U.S. PATENT DOCUMENTS

| | | | |
|---|---|---|---|
| 2,456,365 | 12/1948 | Branch . | |
| 3,286,747 | 11/1966 | Decellier . | |
| 3,783,918 | 1/1974 | Simpson et al. . | |
| 3,804,346 | 4/1974 | Norman . | |
| 3,807,470 | 4/1974 | Young . | |
| 3,955,608 | 5/1976 | Smiltneek | 144/208.9 |
| 4,293,014 | 10/1981 | Lundmark . | |
| 4,369,823 | 1/1983 | Gustafsson . | |
| 4,424,938 | 1/1984 | Day . | |
| 4,580,734 | 4/1986 | Eroskey et al. . | |
| 4,583,575 | 4/1986 | Lundmark | 144/208.9 |
| 4,609,158 | 9/1986 | Wilson . | |
| 4,645,133 | 2/1987 | Hagiwara et al. . | |
| 5,005,621 | 4/1991 | Woodham . | |
| 5,148,844 | 9/1992 | Robison . | |
| 5,638,887 | 6/1997 | Didion . | |

OTHER PUBLICATIONS

"Trellex Rubber Linings for Debarking Drums" Svedala Brochure, 4 pages, undated.

"Trellex Rubber Linings for Debarking Drums" Svedala Brochure, 6 pages, undated.

*Primary Examiner*—W. Donald Bray

*Attorney, Agent, or Firm*—Foley & Lardner

[57] ABSTRACT

A liner for a corrugated debarking drum having a continuously undulating outer wall with an interior surface including an axially extending concave portion includes an elastomeric compressible body having an inner surface adapted to be positioned over the concave portion and an outer surface opposite the inner surface and a support secured to the body and adapted to be bonded to the interior surface without perforating the outer wall.

22 Claims, 3 Drawing Sheets

FIG. 3
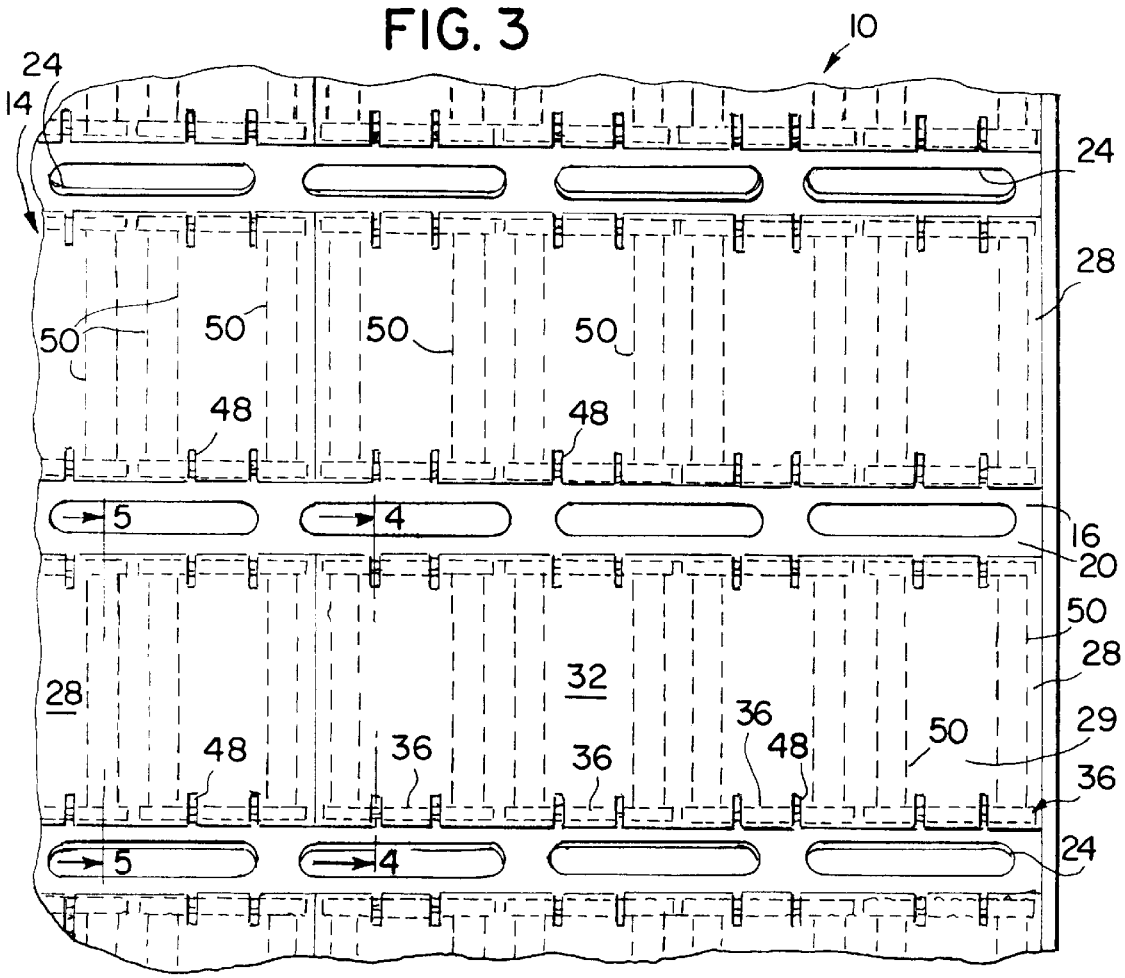
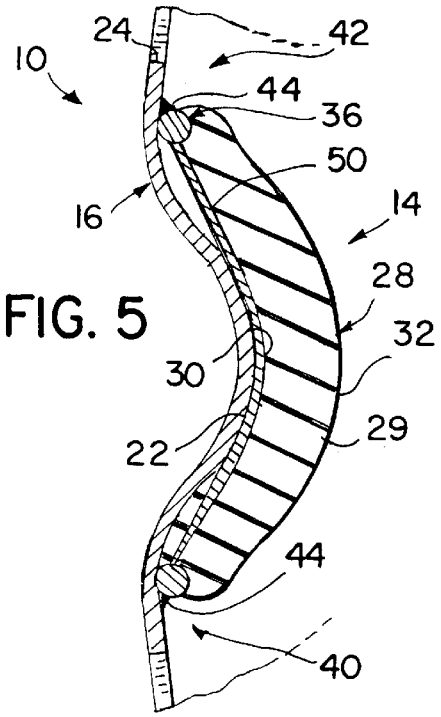
FIG. 5
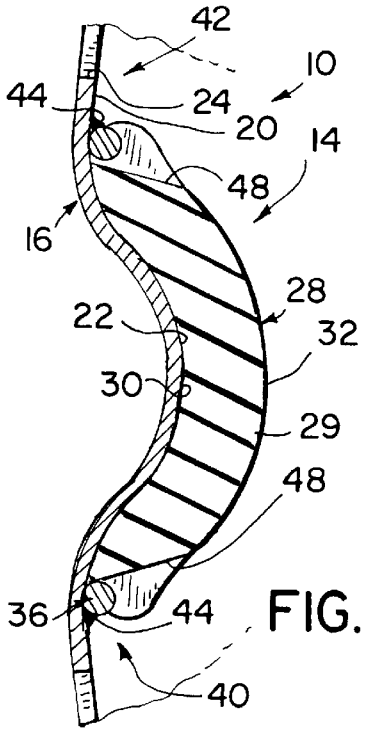
FIG. 4

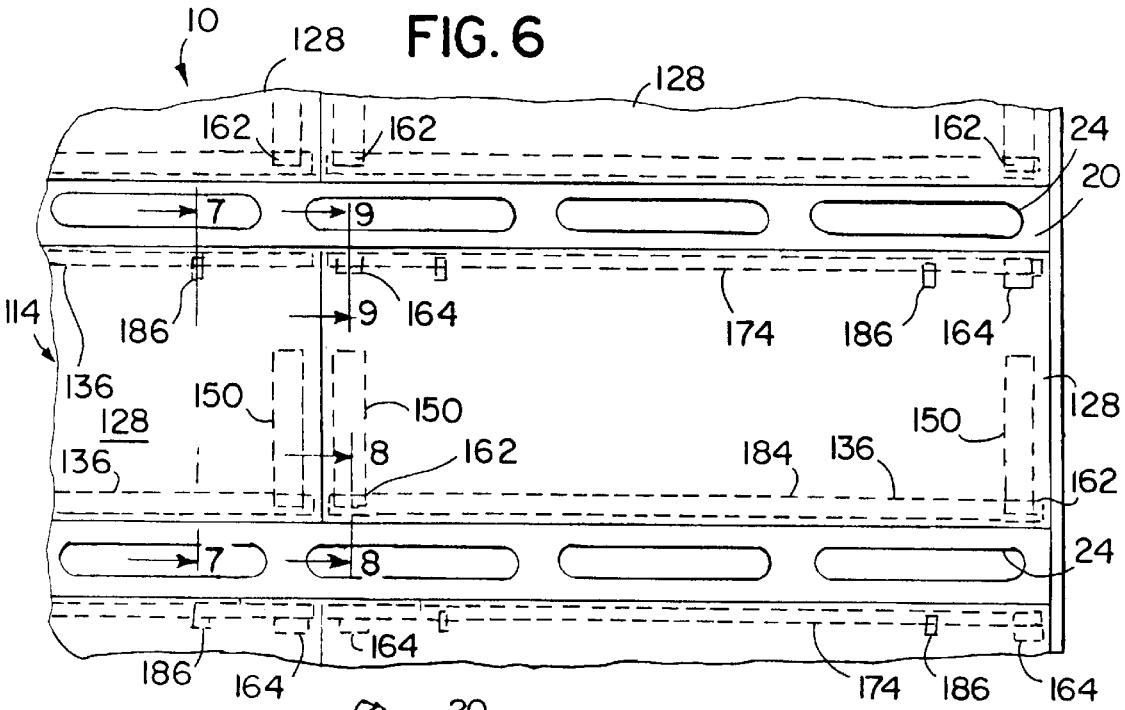
FIG. 6
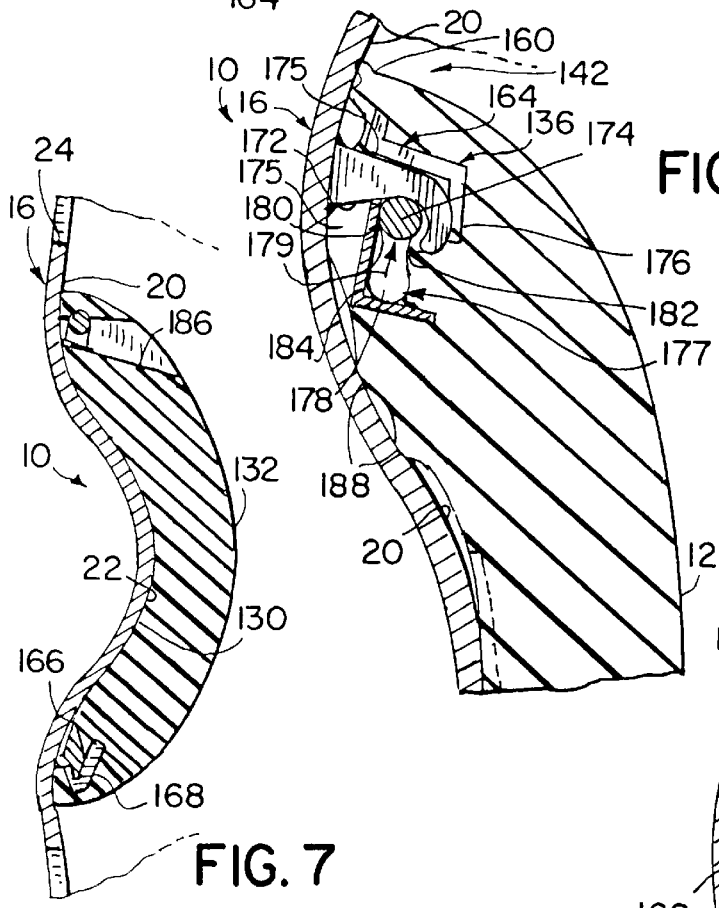
FIG. 7
FIG. 9
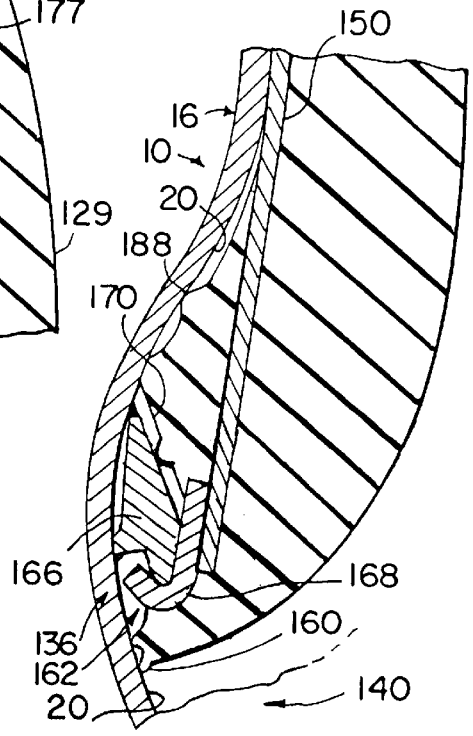
FIG. 8

RUBBER LINING FOR CORRUGATED DEBARKING DRUM

FIELD OF THE INVENTION

The present invention relates to corrugated debarking drums having continuously undulating outer walls within an interior surface including an axially extending concave portion. In particular, the present invention relates to a liner for extending the useful life of the corrugated debarking drum wherein the liner is positioned over the concave portion and secured to the interior surface of the drum without perforating the outer wall.

BACKGROUND OF THE INVENTION

Debarking drums are generally elongate drums sized for receiving and tumbling logs to remove the bark therefrom. There are generally two types of debarking drums: cylindrical and corrugated. Cylindrical debarking drums generally have a smooth, slightly arcuate outer wall to provide the drum with a circular cross-section. Axially extending elongate slots extend through the wall to provide openings through which removed bark is discharged from the drum. To tumble cut logs, cylindrical debarking drums are typically provided with axially extending staves or lifters which axially extend along the length of the drum. These lifters are typically formed of metal or rubber. To reduce noise and extend the life of the drum, metal lifters are often lined with rubber. The rubber lifters as well as the rubber liners covering the metal lifters are typically clamped or bolted to the outer wall with fastening devices which extend through perforations in the outer wall.

Although cylindrical debarking drums are commonly used in the industry, cylindrical debarking drums have several inherent disadvantages. Because cylindrical debarking drums equipped with rubber lifters or rubber liners must have outer walls with increased thicknesses to prevent fractures of the outer wall about the perforations used to clamp or bolt the rubber lifters or liners to the drum and because the lifters or staves add a significant amount of weight to drum, cylindrical debarking drums are generally excessive in weight which results in high power consumption during operation. Because each lifter must be individually secured within the drum, cylindrical debarking drums are difficult and expensive to erect. Moreover, because the lifters themselves are attached to the outer wall of the drum, the lifters lack torsional rigidity which causes the fastening devices or welds securing the lifters to the drum to frequently fail.

In response to these disadvantages associated with cylindrical debarking drums, corrugated debarking drums have been developed. One such corrugated debarking drum is illustrated in U.S. Pat. No. 3,286,747. As illustrated in U.S. Pat. No. 3,286,747, corrugated debarking drums have an undulating or wavy outer wall which inherently forms lifters axially extending along the length of the drum between the elongate slots through which bark is discharged. Because the undulating outer wall inherently forms lifters, corrugated debarking drums do not require additional steel or rubber lifters to be added to the drum. As a result, corrugated debarking drums are lighter in weight so as to require lower power consumption during operation, are less complex and less expensive to erect and are not susceptible to fastening device or weld failures. Despite these numerous advantages, corrugated debarking drums are more susceptible to wear. Because the outer wall of corrugated debarking drums are relatively thin, extending the useful life of corrugated debarking drums by the use of rubber liners as used with cylindrical debarking drums is generally not desirable since perforating the outer wall of the corrugated drum weakens the integrity of the outer wall and makes the outer wall more susceptible to fatigue and cracking. Consequently, corrugated debarking drums are usually manufactured as a cheap, inexpensive disposable debarking drum.

SUMMARY OF THE INVENTION

The present invention is directed to a liner for a corrugated debarking drum having a continuously undulating outer wall with an interior surface including an axially extending concave portion. The liner includes an elastomeric compressible body having an inner surface adapted to be positioned over the concave portion and an outer surface opposite the inner surface. The liner further includes a support secured to the body and adapted to be bonded to the interior surface without perforating the outer wall.

According to one aspect of the present invention, the support includes a first connector secured to the leading edge of the body and bonded to the interior surface of the outer wall and a second connector secured to the trailing edge of the body and bonded to interior surface of the outer wall. The first connector preferably includes a first hook bonded to the interior surface and a second hook secured to the leading edge of the body and releasibly attached to the first hook. The second connector preferably includes a hook bonded to the interior surface and a hook engaging member secured to the trailing edge of the body and releasibly attached to the hook. The hook engaging member is supported by the body and is moveable between a first hook disengaged position and a second hook engaged position. The body preferably includes a passageway in communication with the hook engaging member to provide access to the hook engaging member so as that the hook engaging member may be moved between the disengaged and engaged positions.

According to another aspect of the present invention, the support includes a first connector secured to the leading edge of the body and bonded to the interior surface of the outer wall and a second connector secured to the trailing edge of the body and bonded to the interior surface of the outer wall. The first and second connectors are preferably welded to the interior surface without perforating the outer wall. The first and second connectors are also preferably co-molded at least partially in the body.

According to yet another aspect of the present invention, the liner includes a reinforcement member secured to the body and extending from the leading edge towards the trailing edge. The reinforcement member is preferably co-molded at least partially in the body.

BRIEF DESCRIPTION OF THE DRAWINGS

FIG. 3 is a side elevational view of the drum and liner system of FIG. 2 taken along lines 3—3.

FIG. 4 is a sectional view of the drum and liner system of FIG. 3 taken along lines 4—4.

FIG. 5 is a sectional view of the drum and liner system of FIG. 3 taken along lines 5—5.

FIG. 6 is a side elevational view of a drum incorporating a second embodiment of the liner system of FIGS. 1–5.

FIG. 7 is a sectional view of the drum and liner system of FIG. 6 taken along lines 7—7.

FIG. 8 is a sectional view of the drum and liner system of FIG. 6 taken along lines 8—8.

FIG. 9 is a sectional view of the drum and liner system of FIG. 6 taken along lines 9—9.

DETAILED DESCRIPTION OF THE PREFERRED EMBODIMENTS

Figure 1:
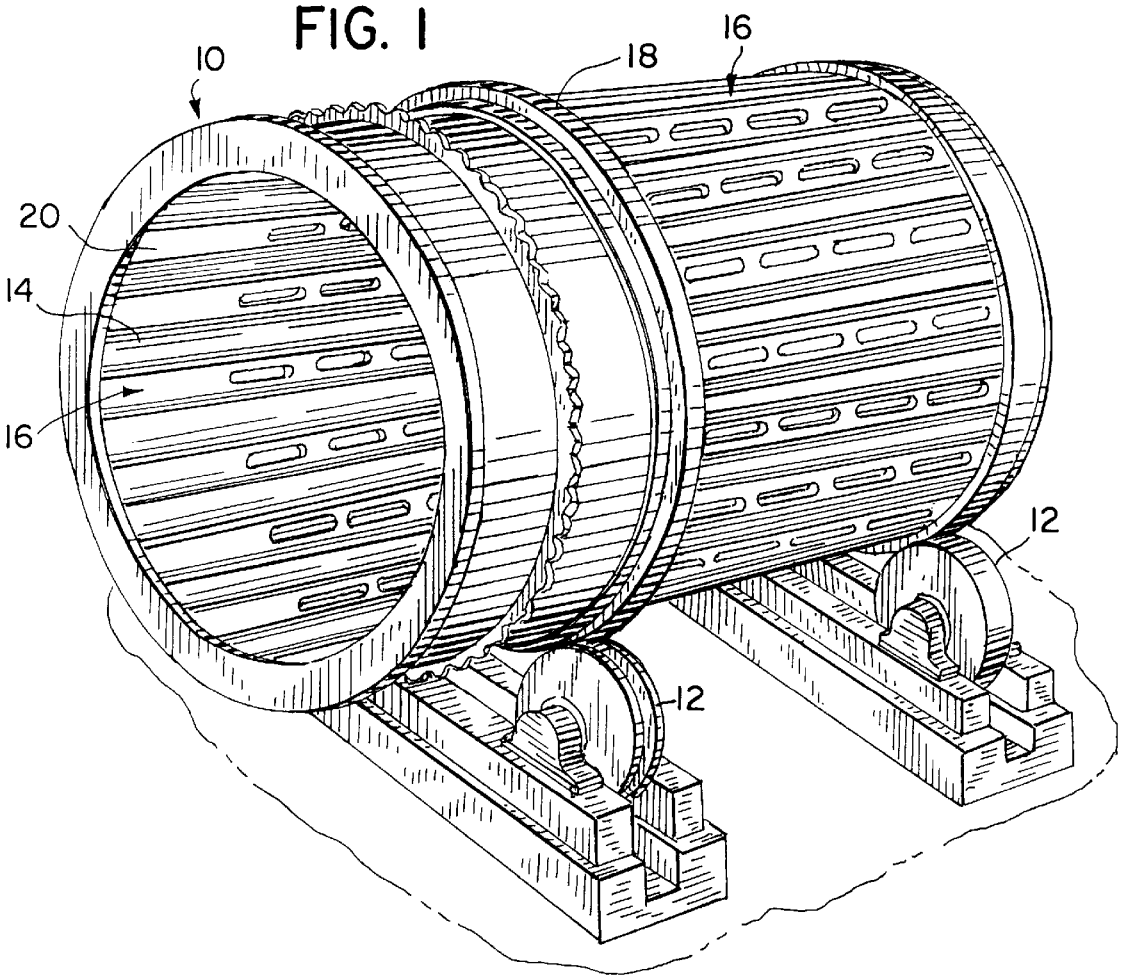
FIG. 1 is a perspective view of a drum including a liner system of the present invention.
Figure 2:
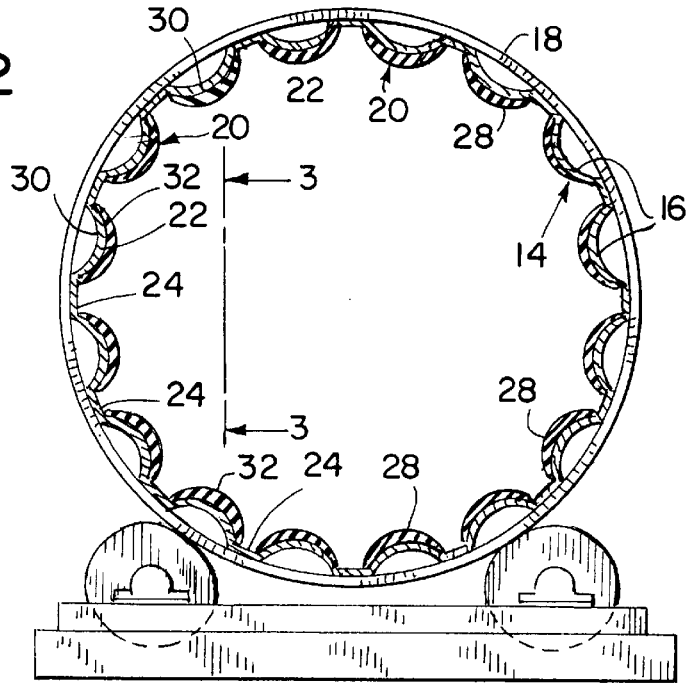
FIG. 2 is a cross-sectional view of the drum and liner system of FIG. 1.

FIGS. 1 and 2 illustrate debarking drum 10 rotatably supported by conventionally known trunion wheels 12 and provided with liner system 14 of the present invention. FIG. 1 is a perspective view of drum 10 and liner system 14. FIG. 2 is a cross-sectional view of drum 10 and liner system 14. FIG. 1 is a perspective view of a corrugated debarking drum 10 rotatably supported by conventionally known trunion wheels 12 for enabling drum 10 to rotatably driven by conventionally known driving means (not shown). Corrugated debarking drum 10 is generally a cylindrical drum having a continuously undulating arcuate outer wall 16 with outer reinforcing rings 18. Undulating outer wall 16 has an interior surface 20 which includes a plurality of axially extending concave portion 22 which project towards the radial center of drum 10. Debarking drum 10 further includes a plurality of axially extending elongate slots 24 extending through outer wall 16 between concave portion 22. Slots 24 are preferably sized for discharging removed bark from drum 10.

Liner system 14 includes a plurality of individual liners 28 extending over concave portion 22 of the interior surface 20 of outer wall 16. Liners 28 are generally elongate arcuate elastomeric compressible bodies 29 formed from rubber having an inner surface 30 positioned over and adjacent to concave portion 22 and an outer surface 32 opposite inner surface 30. Bodies 29 may alternatively be formed from a variety of other resilient, elastomeric compressible materials. Each liner 28 includes a support 36 (shown in FIGS. 3–5) that is secured to the body of liner 14 and bonded to the interior surface 20 of outer wall 16 without perforating outer wall 16.

Liner system 14 extends the useful life of corrugated debarking drum 10 and reduces noise emissions from debarking drum 10 during the debarking of cut logs. Because liner system 14 includes a support 36 secured to the body of each liner 28 that is bonded to the interior surface 20 of outer wall 16 without perforating outer wall 16, liner system 14 does not weaken the integrity of outer wall 16 and also does not make drum 10 susceptible to fatigue or cracking. Moreover, because liner system 14 does not require perforations in outer wall 16, liner system 14 may be used to extend the useful life of the existing conventional corrugated debarking drums which are not otherwise provided with apertures or perforations. As a result, liner system 14 maintains the lightweight, low-power consumption, simplicity and lower cost advantages of corrugated debarking drums while extending the useful life of corrugated debarking drums without impractical expense.

FIGS. 3–5 illustrate liner system 14 in greater detail. FIG. 3 is a side elevational view taken along lines 3—3 of FIG. 2. FIGS. 4 and 5 are sectional views taken along lines 4—4 and 5—5 of FIG. 3. As best shown by FIG. 3, liners 28 are secured over interior surface 20 of drum 10 end-to-end along the axial length of drum 10 between slots 24 so as to substantially cover and line the interior surface 20 of wall 16. Each liner 28 comprises an elastomeric compressible body 29 bonded to wall 16 by at least one support 36. As best shown by FIGS. 4 and 5, supports 36 comprise elongate rigid metallic members affixed to elastomeric compressible body 29 at the leading edge 40 and trailing edge 42 of each liner 28. In the embodiment illustrated, supports 36 are co-molded with elastomeric compressible body 29. As a result, supports 36 are more securely and less expensively affixed to elastomeric compressible body 29. In addition to enabling elastomeric compressible body 29 of liner 28 to be bonded to wall 16 of drum 10 without perforating wall 16, supports 36 also rigidify and strengthen liner 28 at both its leading edge 40 and trailing edge 42.

To facilitate the welding of supports 36 to interior surface 20, each elastomeric compressible body 29 includes a slot 48 extending through elastomeric compressible body 29 from outer surface 32 to inner surface 30. As a result, attachment of liner 28 to drum 10 in a compact close arrangement is simpler and less time consuming. Although FIG. 3 illustrates liners as including a plurality of supports 36 axially extending along both the leading edge 40 and trailing edge 42, supports 36 of each liner 28 may alternatively comprise a single elongate support extending along each of the leading edge 40 and trailing edge 42 of liner 28. Although less desirable, supports 36 may have a variety of other shapes and configurations and may be bonded to outer wall 16 so long as supports 36 do not perforate outer wall 16.

As shown by FIGS. 3 and 5, each liner 28 additionally includes reinforcement members 50. Reinforcement members 50 preferably comprise elongate stiffening bands coupled to elastomeric compressible body 29 and extending from leading edge 40 towards trailing edge 42 of liner 28. In the embodiment illustrated, reinforcement members 50 are co-molded with elastomeric compressible body 29 and extend from support 36 at the leading edge 40 to support 36 at the trailing edge 42. Reinforcement members 50 are preferably fixedly secured to supports 36 at leading edge 40 and trailing edge 42. Reinforcement members 50 strengthen and rigidify elastomeric compressible body 29 against forces encountered during the debarking of logs by drum 10. As a result, reinforcement members 50 prolong the life of liners 28. Reinforcement members 50 further assist in maintaining liners 28 in close relationship with interior surface 20 of wall 16. Because reinforcement members 50 are preferably resiliently deformable between leading edge 40 and trailing edge 42, liners 28 may be slightly deformed to conform to concave portion 22 of wall 16 to facilitate employment and to further eliminate gaps where corrosion and wear of wall 16 may result. Alternatively, reinforcement members 50 may be rigid and may be precisely formed to match concave portion 22. As best shown by FIG. 3, reinforcement members 50 are preferably axially spaced along the length of each liner 28 with at least one reinforcement member 50 located at each opposite axial end of each liner 28. Alternatively, reinforcement members 50 may be located in various locations along the axial length of liners 28. Although less desirable, reinforcement members 50 may alternatively be affixed to elastomeric compressible body 29 by means other than co-molding. Reinforcement members 50 may also alternatively extend only partially from leading edge 40 towards trailing edge 42. Because reinforcement member 50 is co-molded with elastomeric compressible body 29, reinforcement member 50 is less likely to be separated from elastomeric compressible body 29 and is protected from corrosion and wear.

FIGS. 6–9 illustrates liner system 114, a second embodiment of liner system 14 illustrated in FIGS. 2–5. FIG. 6 is a fragmentary side elevational view of liner system 114 within the interior of drum 10. FIGS. 7, 8 and 9 are sectional views taken along lines 7—7, 8—8, and 9—9, respectively of FIG. 6. As best shown by FIG. 6, liner system 114 includes liners 128 which are secured over interior surface 20 of drum 10 end-to-end along the axial length of drum 10 between slots 24 so as to substantially line the interior surface 20 of wall 16. Similar to liners 28, liners 128 include a body 129 bonded to wall 16 by at least one support 136. Similar to elastomeric compressible body 29, body 129 of each liner 128 includes an inner surface 130 positioned over and adjacent to concave portion 22 and an outer surface 132 opposite inner surface 130. Inner surface 130 includes protuberances or lips 160 at the leading edge 140 and trailing edge 142 of liner 128. Lips 160 compress and seal against interior surface 20 of wall 16 to prevent material from wedging under the leading or trailing edges of liner 128.

As best shown by FIGS. 7–9, supports 136 each include a first connector 162 secured to leading edge 140 of body 129 and bonded to interior surface 20 of outer wall 16 and a second connector 164 secured to trailing edge 142 of body 129 and bonded to interior surface 20 of outer wall 16. Connector 162 generally includes hook members 166 and 168. Hook member 166 generally comprises a rigid, preferably metallic, wedge hook welded or otherwise bonded to interior surface 20. Hook 166 preferably extends substantially along the entire length of drum 10. Hook 166 projects into a cavity 170 defined by elastomeric compressible body 129 for engagement with hook 166. Hook member 168 preferably comprises a rigid J-hook preferably extending the entire axial length of liner 128. Hook 168 is preferably co-molded with body 129 at leading edge 140 and is located so as to engage hook 166 to secure leading edge 140 of liner 128 to drum 10. Alternatively, a plurality of hook members 166 and hook members 168 may be intermittently spaced along the length of drum 10 so as to engage one another.

As best shown by FIGS. 7 and 9, connector 164 generally includes a first hook 172 bonded to interior surface 20 and a hook engaging member 174 secured to trailing edge 142 of liner 128 and releasibly attached to hook 172. Hook 172 is preferably welded to interior surface 20 and projects into a cavity 175 defined within body 129 to engage member 174. Cavity 175 is preferably braced with an elongate rigid metallic support member 176 having a Z-shaped cross-section. Support member 176 is co-molded with body 129 adjacent cavity 175 opposite landing 184 at a location such that support member 176 butts against hook 172 when liner 128 is mounted to drum 10.

Hook engaging member 174 preferably comprises a slide bar which is movable from a first hook disengaged position to a second hook engaging position as indicated by arrow 179. Hook engaging member 174 generally comprises a round metal bar having a length equal to the axial length of liner 128 and fitted into slot 177 in body 129. Slot 177 preferably has a lazy eight cross-sectional shape and includes openings 178, 180 and a rounded V rib or ridge 182. Openings 178 and 180 have a cross-sectional diameter essentially equal to the diameter of member 174. Opening 178 receives member 174 and retains member 174 in the hook disengaged position. Opening 180 receives and retains member 174 in a hook engaged position. Ridge 182 projects in between openings 178 and 180 and is resiliently flexible or deformable so as to bias member 174 into either the hook disengaged position or the hook engaged position.

As further shown by FIG. 9, hook engaging member 174 is additionally supported within body 129 by a rigid metallic landing 184 co-molded with body 129. Landing 184 extends over the entire axial length of liner 128 to distribute the latching force of member 174 over a large area of body 129 to provide a higher clamping force and to more securely attach liner 128 to drum 10.

To facilitate movement of member 174 between the disengaged position and the engaged position with respect to hook 172, body 129 of liner 128 includes two narrow slots 186 proximate the opposite axial ends of liner 128 axially spaced with respect to hooks 172. Slots 186 extend through body 129 and provide access to member 174. Slots 186 enable the insertion of a bar or other tool (not shown) into body 129 and into engagement with member 174 to move member 174 between the engaged and disengaged positions as indicated by arrow 179.

To facilitate the engagement of hook 168 with hook 166 and hook engaging member 174 with hook 172, as well as to provide a bias or preload against hook 166 and hook 172 to reliably secure liner 128 to drum 10, body 129 includes resilient ridges 188 on inner surface 130. Ridges 188 are resiliently flexible and/or deformable so as to act as springs such that compression of ridges 188 during insertion of liner 128 enables hooks 168 and 166 and hook engaging member 174 and hook 172 to engage one another. Once hooks 166 and 172 are engaged, release of pressure against body 129 causes ridges 188 to return to their initial shape so as to bias or preload hook 168 and member 174 against hooks 166 and 172, respectively.

Similar to liner 28, liners 128 each include reinforcement members 150. Reinforcement members 150 are generally elongate rigid metallic bars supported within body 129. Members 150 extend roughly parallel to the inner concave geometry of inner surface 130. Reinforcement members 150 are preferably co-molded with body 129 and extend from hook 168 at leading edge 140 towards trailing edge 142. Reinforcement members 150 preferably extend from hook 168 approximately ¾ of the way towards cavity 175. As a result, reinforcement members 150 provide slight length compliance to aid in installation and to maintain a longitudinal preload and thus a snug installation of liner 128. Reinforcement members 150 further reinforce liner 128 against longitudinal rubber creep caused by the continual impingement of logs against liner 128 as drum 10 rotates.

Installation of lining system 114 to an existing corrugated drum 10 can be performed simply and quickly without perforating outer wall 16 of drum 10. At least two spaced hooks 166 are bonded, preferably welded, to inner surface 20 of outer wall 16 adjacent leading edge of a slot 24. At least two spaced hooks 172 are bonded, preferably welded, to interior surface 20 of outer wall 16 adjacent the trailing edge of a slot 24. Liner 128 is then mounted to hooks 166 and 172 by first positioning hook member 168 into engagement with hook member 166. Once hook members 166 and 168 are interengaged, hook 172 is positioned within cavity 175. The use of a tool inserted through slot 186 enables movement of member 174 into engagement with hook 172. This is repeated at each end of liner 128. The removal of liner 128 is achieved by reversing these steps. Hooks 166 and 172 permanently remain within drum 10. Upon wear of liner 128, liner 128 is removed using the described procedure and replaced with another similar liner 128 using the described procedure. Consequently, liner system 114 provides liners which may be easily removed and replaced as necessary to protect and extend the useful life of drum 10 without perforating drum 10.

Although the present invention has been described with reference to preferred embodiments, workers skilled in the art will recognize that changes may be made in form and detail without departing from the spirit and scope of the invention. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. In a corrugated debarking drum having a continuously undulating outer wall with an interior surface including an axially extending concave portion, an improvement comprising:

a liner including:

an elastomeric compressible body having a leading edge, a trailing edge, an inner surface positioned over the concave portion and an outer surface opposite the inner surface; and a support secured to the body and bonded to the interior surface without perforating the outer wall.

2. The improved corrugated debarking drum of claim 1, wherein the support includes:

a first connector secured to the leading edge of the body and bonded to the interior surface of the outer wall; and a second connector secured to the trailing edge of the body and bonded to the interior surface of the outer wall.

3. The improved corrugated debarking drum of claim 2, including:

a reinforcement member extending between and attached to the first and second connectors.

4. The improved corrugated debarking drum of claim 3, wherein the first and second connectors are welded to the interior surface without perforating the outer wall.

5. The improved corrugated debarking drum of claim 4, wherein the first and second connectors are co-molded at least partially in the body.

6. The improved corrugated debarking drum of claim 2, wherein the first and second connectors are co-molded at least partially in the body.

7. The improved corrugated debarking drum of claim 2, wherein the first connector includes:

a first member bonded to the interior surface and a second member secured to the leading edge of the body and releasibly attached to the first member.

8. The improved corrugated debarking drum of claim 7, wherein the first member includes a hook and wherein the second member includes a hook engaging portion.

9. The improved corrugated debarking drum of claim 2, wherein the second connector includes:

a first member bonded to the interior surface; and a second member secured to the trailing edge of the body and releasibly attached to the first member.

10. The improved corrugated debarking drum of claim 9, wherein the first member includes a hook and wherein the second member includes a hook engaging member.

11. The improved corrugated debarking drum of claim 10, wherein the hook engaging member is supported by the body and wherein the hook engaging member is movable between a first hook disengaged position and a second hook engaged position.

12. The improved corrugated debarking drum of claim 11, wherein the body includes a passage way in communication with the hook engaging member to permit access to the hook engaging member so that the hook engaging portion may be moved between the first hook disengaged position and the second hook engaged position.

13. The improved corrugated debarking drum of claim 11, wherein the hook engaging portion comprises a bar movable within a slot defined by the body and wherein the slot includes a resilient rib configured so as to removably maintain the hook engaging member in either the first hook disengaged position or the second hook engaged position.

14. The improved corrugated debarking drum of claim 11, including a rigid landing axially extending within the elastomeric compressible body and supporting the hook engaging member.

15. The improved corrugated debarking drum of claim 2, wherein the first and second connectors each include a first member bonded to the interior surface without perforating the outer wall and a second member secured to the body and releasibly attached to the first member.

16. The improved corrugated debarking drum of claim 1, wherein the elastomeric compressible body includes lips on at least one of the leading edge and the trailing edge for sealing against the interior surface.

17. The improved corrugated debarking drum of claim 1, including a reinforcement member secured to the body and extending from the leading edge towards the trailing edge.

18. The improved corrugated debarking drum of claim 17, wherein the reinforcement member is co-molded at least partially in the body.

19. The improved corrugated debarking drum of claim 1, including first and second reinforcement members attached to the body at first and second opposite ends of the body, wherein the first and second reinforcement members extend from the leading edge towards the trailing edge.

20. A liner for a debarking drum having an interior surface with an axially extending concave portion, the liner comprising:

an elastomeric compressible body having a leading edge, a trailing edge an inner surface adapted to be positioned over the concave portion and an outer surface opposite the inner surface; and a support co-molded at least partially in the body and adapted to be bonded to the interior surface of the drum without perforating the drum.

21. The liner of claim 20 including the reinforcement member co-molded at least partially in the body and extending from the leading edge towards the trailing edge.

22. A debarking drum comprising:

a continuously undulating outer wall with an interior surface including an axially extending concave portion; and a liner including:

an elastomeric compressible body having a leading edge, a trailing edge, an inner surface positioned over the concave portion, and an outer surface opposite the inner surface; and a support secured to the body and bonded to the interior surface without perforating the outer wall.

* * * * *